US007588478B2

(12) United States Patent
Lashinsky

(10) Patent No.: US 7,588,478 B2
(45) Date of Patent: Sep. 15, 2009

(54) ACTION FIGURE AND ACCESSORIES

(76) Inventor: Michael Lashinsky, HC 60 Box 4010, Haines, AK (US) 99827

( * ) Notice: Subject to any disclaimer, the term of this patent is extended or adjusted under 35 U.S.C. 154(b) by 738 days.

(21) Appl. No.: 11/086,688

(22) Filed: Mar. 22, 2005

(65) Prior Publication Data

US 2006/0217030 A1 Sep. 28, 2006

(51) Int. Cl.
*A63H 29/22* (2006.01)

(52) U.S. Cl. ..... 446/484; 446/485; 446/473; 446/91

(58) Field of Classification Search ..... 446/91–95, 446/175, 485, 484, 473, 406, 405
See application file for complete search history.

(56) References Cited

U.S. PATENT DOCUMENTS

| | | | | |
|---|---|---|---|---|
| 3,949,517 | A | 4/1976 | Reiner | |
| 3,955,312 | A | 5/1976 | Pugh | |
| 4,267,551 | A | 5/1981 | Dankman et al. | |
| 4,626,222 | A | 12/1986 | Sweet | |
| 4,710,146 | A | 12/1987 | Rasmussen et al. | |
| 4,902,262 | A | 2/1990 | Lunsford | |
| 5,013,276 | A * | 5/1991 | Garfinkel | 446/484 |
| 5,073,140 | A * | 12/1991 | Lebensfeld et al. | 446/297 |
| 5,147,237 | A * | 9/1992 | Kwan et al. | 446/297 |
| 5,277,643 | A * | 1/1994 | Ejima | 446/93 |
| 5,295,889 | A * | 3/1994 | Ejima | 446/91 |
| 5,466,181 | A | 11/1995 | Bennett et al. | |
| 6,071,166 | A * | 6/2000 | Lebensfeld et al. | 446/175 |
| 6,257,948 | B1 * | 7/2001 | Silva | 446/100 |
| 6,547,623 | B1 * | 4/2003 | Collado | 446/47 |
| 6,575,810 | B1 * | 6/2003 | Sohn | 446/485 |
| 6,648,719 | B2 * | 11/2003 | Chan | 446/297 |
| 6,817,921 | B2 | 11/2004 | Chin et al. | |

* cited by examiner

*Primary Examiner*—Gene Kim
*Assistant Examiner*—Urszula M Cegielnik
(74) *Attorney, Agent, or Firm*—Anthony Claiborne

(57) ABSTRACT

An articulated action figure, in conjunction with a battery pack, is adapted for providing power to electrical accessories that may be removably attached to the figure. The battery pack, fashioned as an appropriately scaled accessory, provides for removable, electrically conductive attachment to a cooperating receiving area of the action figure. The action figure conducts current internally from the battery pack receiving area to conductive surfaces disposed on specific areas of the figure, such as extremities, fashioned for removable retention of accessories. Advantageously, the present invention provides a means of conducting current through the figure at its points of articulation without requiring flexing of conductors. Suitably fashioned electrical accessories, such as simulated laser guns, removably retained by the figure at the aforesaid specific areas, may be provided electrical power through cooperating points in electrical contact with the conductive surfaces of the figure. Embodiments provide for control or modulation of the current supplied from the battery pack through the figure to accessories.

1 Claim, 6 Drawing Sheets

ACTION FIGURE AND ACCESSORIES

BACKGROUND OF THE INVENTION

1. Field of the Invention

This invention relates to toy figures with articulated limbs. More particularly, this invention relates to such figures that are adapted to employ electrically powered accessories.

2. Description of the Related Art

Dolls and other miniature human figures have been favorite toys from time immemorial. In recent years, toys such as the Star Wars® action figures have enjoyed enormous popularity and success, both as playthings for children and as collectible items for adult enthusiasts.

One common characteristic of most such toys is articulate limbs, whereby the figure's arms are articulated at least at the shoulder and/or the figure's legs are articulated at least at the hip. Articulation of the limbs enhances the utility of such figures for amusement, in that it allows the user to manipulate the figure's limbs so that the figure may assume various poses.

As an exemplary articulated figure, U.S. Pat. No. 1,176,209 to Dice describes a classic poseable doll with head, legs and arms articulately joined to the doll's body at the neck, hips and shoulders respectively with double button mechanisms. U.S. Pat. No. 1,566,801 to Millard describes a doll with limbs and head articulately connected to the doll's body by ball and socket joints. U.S. Pat. No. 6,817,921 to Chin et al. describes an action figure with arms articulated to pivot about the body at the shoulder, characteristic of most action figures, by employing a pivot disc extended from the arm and received by a circular cavity in the body. Chin et al. further describe a neck adapted to attach pivotally to a head.

Another common enhancement of the amusement utility of such a toy is the employment of accessories with which the figure may be posed. The figure's hand is commonly fashioned so that an accessory may be removably retained in the hand as if grasped by the figure. Action figures, in particular, are often provided with toy weapons which may be employed in such a manner. For example, U.S. Pat. No. 3,955,312 to Pugh describes a gripping hand for dolls or action figures adapted to hold accessories such as weapons.

In addition, the figure and accessories may be adapted for attachment to the head of the figure. Such accessories include goggles, visors and the like, as well as hats and various other headgear.

The utility of attachable action figure accessories may be further enhanced by providing operational features. For example, U.S. Pat. No. 4,710,146 to Rasmussen et al. describes a spring-driven simulated weapon accessory for an action figure, while U.S. Pat. No. 4,626,222 to Sweet describes a clockwork operated toy weapon pack accessory. Providing electrically operated features often adds particular amusement utility to such accessories, as in U.S. Pat. No. 4,902,262 to Lunsford, in which the accessory is motorized, or in U.S. Pat. No. 4,267,551 to Dankman et al., in which the accessory contains a light emitting diode (LED) which may be illuminated to simulate the firing of a laser weapon.

Electrical accessories for figures may be small items suitably scaled to be held in the hand of the figure, as in the foregoing examples. Alternatively, larger items, such as toy vehicles, may also advantageously be provided as accessories, wherein the figure may be posed to grasp an appropriate portion of the accessory, as, in the case of a vehicle, the steering wheel or other appropriate simulated hand control. For example, U.S. Pat. No. 3,949,517 to Reiner et al. describes an action figure adapted to grasp a portion of an electrically motorized motorcycle. Larger electrically operated accessories other than vehicles may also advantageously be provided, such as the musical toy with simulated keyboard and lighted vanity mirror for a doll described in U.S. Pat. No. 5,466,181 to Bennett et al.

Accessories adapted to attach to the head of the figure may also provide enhanced amusement utility by electrical operation. For example, visors or goggles may be provided with LEDs simulating glowing eyes. Headgear may be outfitted with mechanisms employing small electrical motors.

In any case, providing electrical power to electrical accessories presents problems. Batteries may be incorporated in the accessories themselves, but the size of even small hearing aid batteries makes them unsuitable for properly scaled small accessories such as handguns for typical five inch action figures. Batteries may instead be incorporated internally in a body cavity in the action figure, such as the batteries in the torso of the doll of Bennett et al., with wire or other conductor providing a path for current from the battery to the accessory. However, the access that must be provided to internal batteries by way of openings with battery covers and the like, so that batteries may be replaced when spent, frustrates the verisimilitude of the figure, thereby diminishing its amusement utility. Power may instead be provided from a source external to the action figure, as in the power supply for the figure of Reiner et al. A battery holder adaptation, such as the backpack power supply of Lunsford, which is both suitably sized for battery form factors and at the same time simulates an appropriately scaled accessory, may be the most desirable form of power supply for an action figure employing electrical accessories.

In any case, though, if the accessory power supply is remote from the accessory, current must be conducted from the power supply to the accessory for operation of the accessory. Current can be provided via external wiring, as in the case of the figure of Reiner et al. However, unless some sort of cord or hose would normally attach to the object which the accessory simulates, the presence of the external wiring destroys verisimilitude. Accordingly, a number of improvements have been directed to hidden means of providing current from the power supply to the accessory.

Reiner et al. describe figures in which current is supplied to the accessory via wiring running internally through the figure, whereas Bennett et al. teach embodiments wherein the power supply is coupled to the accessory via a conductive coating on the surface of the figure, presumably hidden from view by paint or clothing worn by the figure. In either such case, the hand or other portion of the figure retaining the electric accessory is fashioned with conductive areas to couple with corresponding conductive areas of the accessory. When the accessory is retained by the figure, the accessory may receive operative power. Advantageously, adding to the utility of this arrangement, the user may remove the electric accessory from retention by the figure as desired.

However, with articulated figures adapted for electric accessories, the conductive path from the power supply to the figure's conductive areas must flex at the point of articulation. Heretofore, this requirement has presented particular problems. In figures in which current is conducted via wiring, the conductive wires must bend at the figure's articulated joints, leading to metal fatigue of the wire the risk of open circuit to the electric accessory. In figures in which current is conducted via conductive coating on the surface of the figure, abrasion of the coating at joints again presents the same risk.

What is needed is an articulated action figure with battery pack adapted to provide power to electric accessories. What is needed further is such a battery pack that is both suitably sized for battery form factors and at the same time simulates an appropriately scaled accessory. What is needed further is such an action figure with a conductive area in an extremity, such as a hand, completing an electrical circuit from the battery pack is through an appropriately corresponding electrical amusement accessory, such as a simulated light-saber or a motorized mechanism, thereby supplying power to the accessory. What is needed further is such an action figure in which the circuit path from the battery pack to the figure's extremity is internal to the figure and in which the current is conducted through points of articulation without flexing of metal or wear on external conductive surfaces.

BRIEF DESCRIPTION OF THE INVENTION

The present invention is an articulated action figure and battery pack, adapted for providing power to electrical accessories that may be removably attached to the figure. Embodiments include a battery pack fashioned as an appropriately scaled accessory, such as a backpack, providing for removable, electrically conductive attachment to a cooperating receiving area of the action figure. The action figure conducts current internally from the battery pack receiving area to conductive surfaces disposed on specific areas of the figure, such as extremities, fashioned for removable retention of accessories. Advantageously, the present invention provides a means of conducting current through the figure at its points of articulation without requiring flexing of conductors. Suitably fashioned electrical accessories, such as simulated laser guns, removably retained by the figure at the aforesaid specific areas, may be provided electrical power through cooperating points in electrical contact with the conductive surfaces of the figure. Embodiments provide for control or modulation of the current supplied from the battery pack through the figure to accessories.

BRIEF DESCRIPTION OF THE DRAWINGS

Other objects, advantages, features and characteristics of the present invention, as well as methods, operation and function of related elements of structure, and the combination of parts and economies of deployment, will become apparent upon consideration of the following description and claims with reference to the accompanying drawings, all of which form a part of this specification, wherein:

DETAILED DESCRIPTION OF THE PREFERRED EMBODIMENTS

Figure 1:
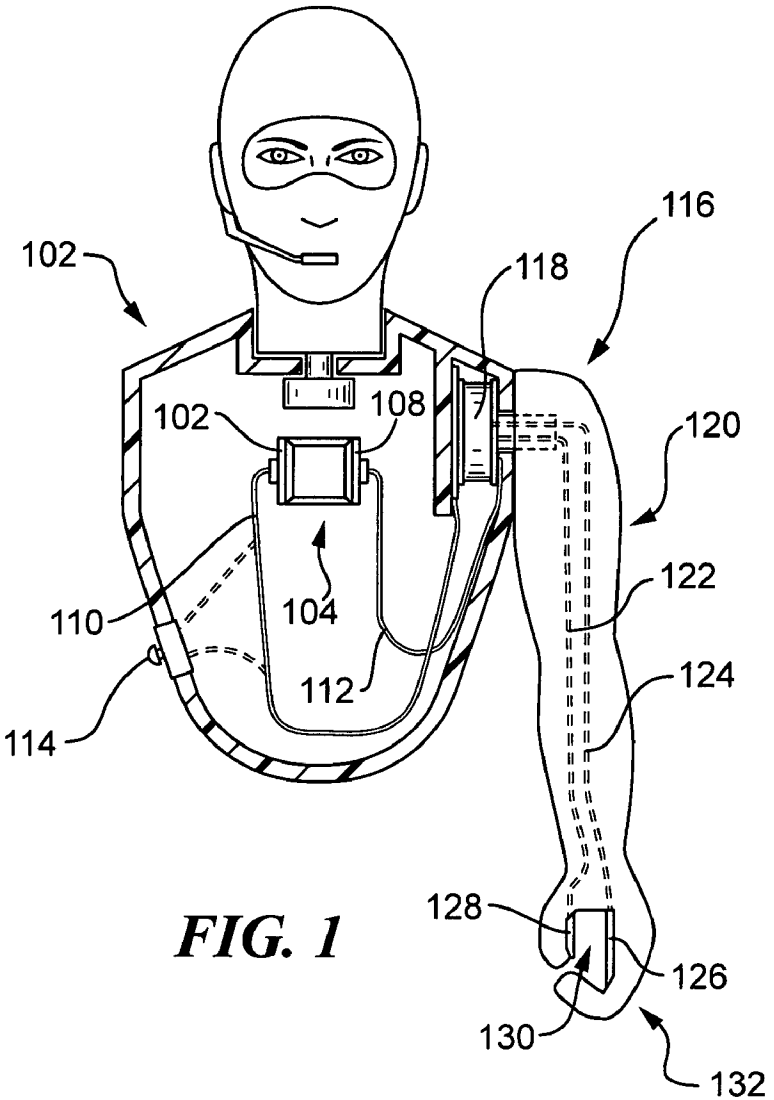
FIG. 1 is a frontal view of a cross section of the torso of the action figure according to the present invention.

Turning to FIG. 1, illustrated is a frontal cross section of the torso 102 of an action figure according to the present invention. Disposed in the action figure's back (seen here from the inside) is a receptacle 104 for removably receiving and retaining a cooperating portion of a battery pack, described in greater detail in reference to FIG. 2 below. On either side of receptacle 104 are contacts 106, 108 for electrical connection to cooperating contacts on the cooperating portion of the battery pack. Current from contacts 106, 108 is conducted through torso 102 via conductors 110, 112. In some embodiments, the figure may be provided with a switch 114, such as a normally open single pole-single throw switch, for the user to switch current on and off through the figure.

Advantageously, current from conductors 110, 112, is transmitted through articulated joint 116 of the figure via pivoting contact apparatus 118, described in greater detail in reference to FIG. 4 below. Current is conducted from pivoting contact apparatus 118 through limb 120 via conductors 122, 124 to conductive areas 126, 128 disposed on either side of a receptacle 130 on extremity 132, the receptacle fashioned to receive and removably retain a cooperating portion of an electrical action figure accessory, described in greater detail in reference to FIG. 3 below. Conductive areas 126, 128 contact cooperating conductive areas on the accessory to provide operative electrical current.

Figure 2A:
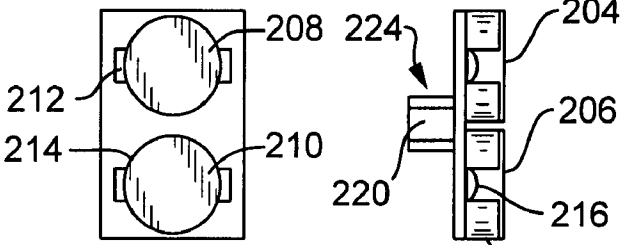
FIG. 2*a* is a rear view of a battery pack according to the present invention.
Figure 2B:
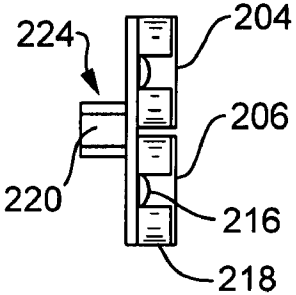
FIG. 2*b* is a transparent side view of the battery pack.
Figure 2C:
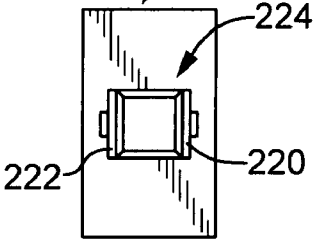
FIG. 2*c* is a front view of the battery pack.

Turning now to FIG. 2, illustrated is a battery pack according to the present invention. In the illustrated embodiment, battery pack 202 contains receptacles 204, 206 for small, disc form factor batteries, such as hearing aid batteries. Batteries are retained in receptacles 204, 206, by battery covers 208, 210, which may be opened on hinges 212, 214 for user access to the batteries. Disposed within receptacles 204, 206 are contacts 216, 218 for receiving positive and negative voltage from the battery, in a manner familiar to those of skill in the art. Voltage from battery contacts 216, 218 is conducted to contacts 220, 222 on a portion 224 of battery pack 202 fashioned to be received and removably retained by the receptacle on the figure's back (104 in FIG. 1). When portion 224 is retained by the action figure, current may flow through contacts 220, 222 to cooperating contacts on the action figure (106, 108 in FIG. 1).

As will be clear to those of skill in the art, other manners of removably receiving and retaining batteries within the battery pack are possible. For example, battery pack 202 may be fashioned in two separable pieces (not illustrated), splitting the battery pack down the middle, the pieces separably joined by hinges, snaps, pages and the like, familiar to those of skill in the art. Such alternative embodiments provide receptacles with contacts for the batteries, and a portion with contacts fashioned to be received and removably retained by the figure, in keeping with the spirit of the present invention.

Figure 3A:
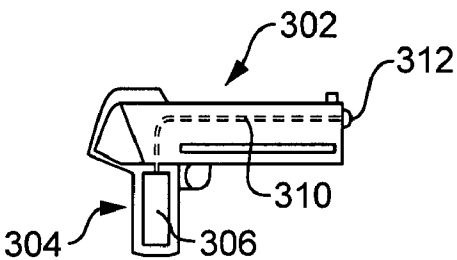
FIG. 3*a* is a transparent side view of a simulated laser handgun accessory according to the present invention.
Figure 3B:
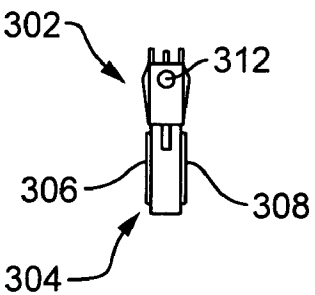
FIG. 3*b* is a front view of the handgun.

Turning now to FIG. 3, illustrated is a simulated laser handgun according to the present invention. Handgun 302 comprises a grip 304 adapted for removable retention in a cooperating receptacle in the hand of the action figure (130 in FIG. 1). Disposed on either side of grip 304 are conductive areas 306, 308 for contact with cooperating conductive areas on the action figure (126, 128 in FIG. 1). Current from conductive areas 306, 308 is carried by conductor pair 310 through the interior of simulated handgun 302 to cause light emitting diode (LED) 312 to illuminate, thereby simulating firing of a laser. Means may be employed for enhancing the appearance of firing by the laser, such as fiber optical components conducting light from the LED, simulating muzzle flash (not illustrated), as will be appreciated by those of skill in the art.

Figure 4:
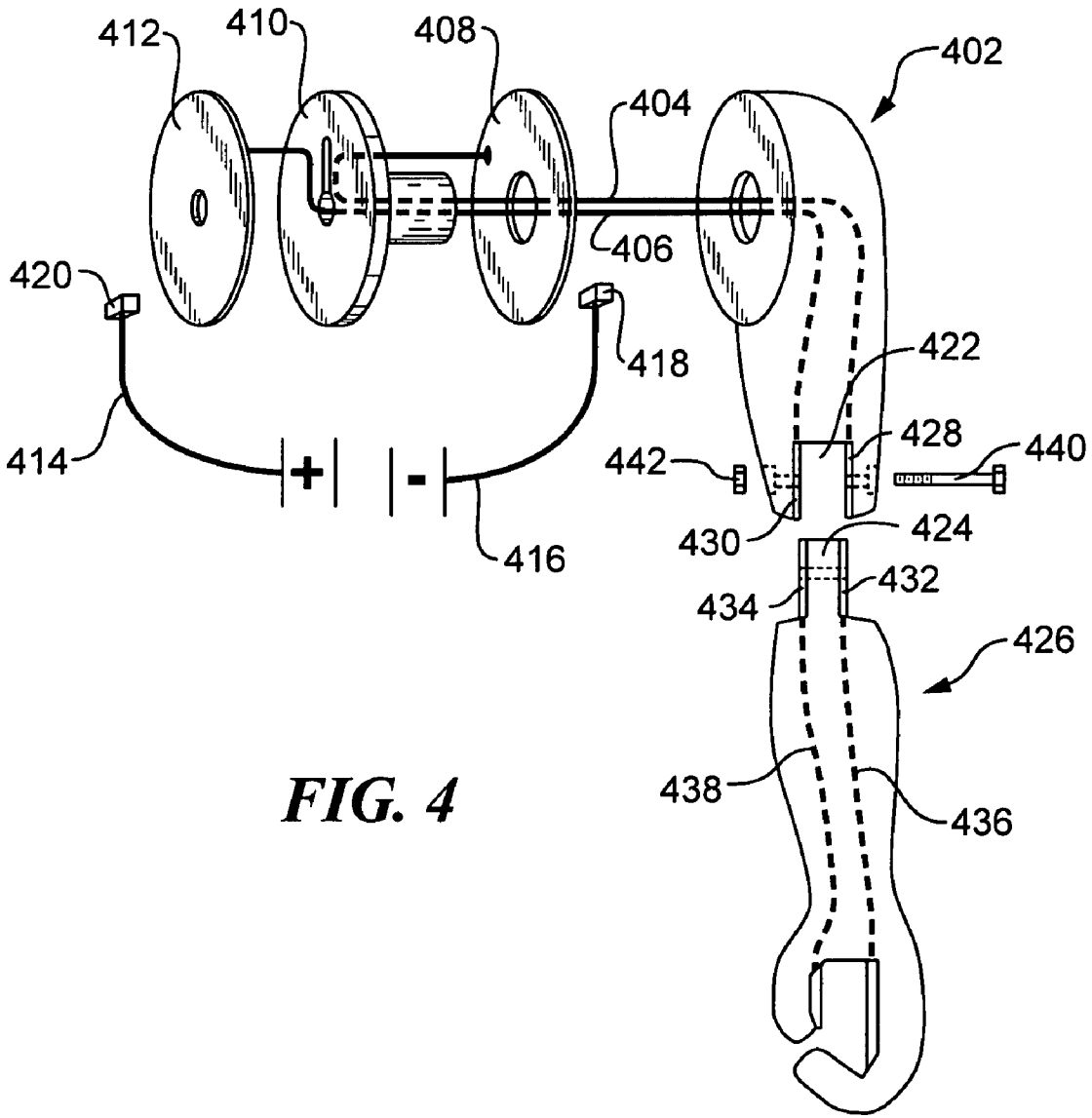
FIG. 4 is an exploded view of a shoulder joint and arm of the figure according to the present invention.

FIG. 4 illustrates an exploded view of the figure's shoulder joint and arm. The articulated shoulder comprises a hollow molded shoulder piece 402, running through which is a pair of conductor wires 404, 406 for conducting negative and positive voltage respectively. In operation, shoulder piece 402 abuts the torso of the figure, as shown in FIG. 1. Wires 404, 406 pass into the torso. One wire 404 terminates on a first conducting disc 408, to which wire 404 is mechanically and electrically connected, by soldering, for example. The other wire 406 passes through the hollow stem of a pin 410 of non-conducting rigid material, such as polystyrene or polyethylene, the head of which separates disc 408 from a second conducting disc 412, to which wire 406 is mechanically and electrically connected. Discs 408, 412 and pin 410 join to form a single assembly. At the point on the torso where shoulder piece 402 abuts, a suitably sized receiving hole receives the stem of pin 410 from the interior of the figure. The stem of pin 410, along with wires 404, 406, passes through the receiving hole in the torso. Wires 404, 406 feed into the interior of hollow shoulder piece 402, and the stem of pin 410 is firmly connected to shoulder piece 402, by gluing, for example.

Electrical current passes from conductors 414, 416 in the interior of the figure (corresponding to conductors 110, 112 in FIG. 1), through brushes 418, 420 that are retained (by single leaf spring or other means of supplying mechanical tension) in electrical contact with discs 408, 412 respectively. Brushes 418, 420, together with the assembly comprising discs 408, 412 and pin 410, thereby form a pivoting contact apparatus, connecting shoulder piece 402 to the torso, conducting current from the conductors inside the torso through the articulated joint, and allowing pivoting of shoulder piece 402 without movement or flexing of wires 404, 406.

The figure's arm may be further articulated by permitting hinged movement at the figure's elbow. In the depicted embodiment, the invention permits such movement, again without need for flexing or movement of conductors. At the elbow, shoulder piece 402 is fashioned with a groove 422 for receiving a cooperating tongue portion 424 of a hollow forearm piece 426. On either side of the interior of groove 422 are conductive areas 428, 430, electrically connected to wires 404 and 406 respectively. On either side of the tongue portion 424 of forearm 426 are cooperating conductive areas 432, 434, electrically connected to wires 436, 438, respectively, running through the interior of forearm piece 426. Forearm 426 is hinged to shoulder piece 402 by retention of tongue 424 within groove 422 by way of a pin arrangement, such as bolt 440 running through a hole passing though shoulder piece 402 and tongue 424 of forearm piece 426, bolt 440 held in place by nut 442 as depicted. When shoulder piece 402 and forearm piece 426 are so connected, conductive areas 428, 430 of shoulder piece 402 are in electrical contact with corresponding conductive areas 432, 434 of forearm piece 426, and current may thereby pass through the elbow to wires 436, 438 in the interior of forearm 426. Groove 422 with its conductive areas 428, 430, engaged by way of pin arrangement 440, 442 with tongue 424 with its cooperating conductive areas 432, 434, forms a hinged contact apparatus, connecting shoulder piece 402 to forearm piece 426, conducting current from the conductors inside shoulder piece 402 through the articulated joint to the conductors inside forearm piece 426, and allowing hinged movement of forearm piece 426 without movement or flexing of wires 404, 406 or wires 436, 438.

As will be appreciated by those of skill in the art, while it is not illustrated here, a similar hinged contact apparatus may be advantageously employed at the shoulder joint in conjunction with the pivoting contact apparatus to permit arms hinged at the shoulder to be raised and lowered within the principal plane of the torso as well as pivoting at the shoulder as previously described.

Figure 5C:
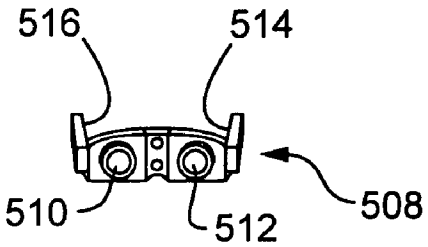
FIG. 5*c* is a goggles accessory according to the present invention.
Figure 5B:
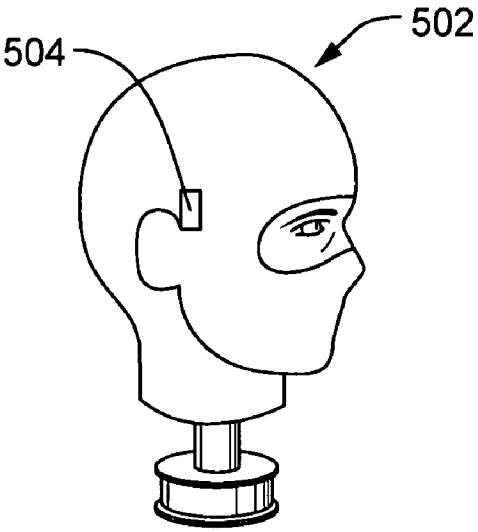
FIG. 5*b* is a side view of the head and neck shown in FIG. 5*a;*
Figure 5A:
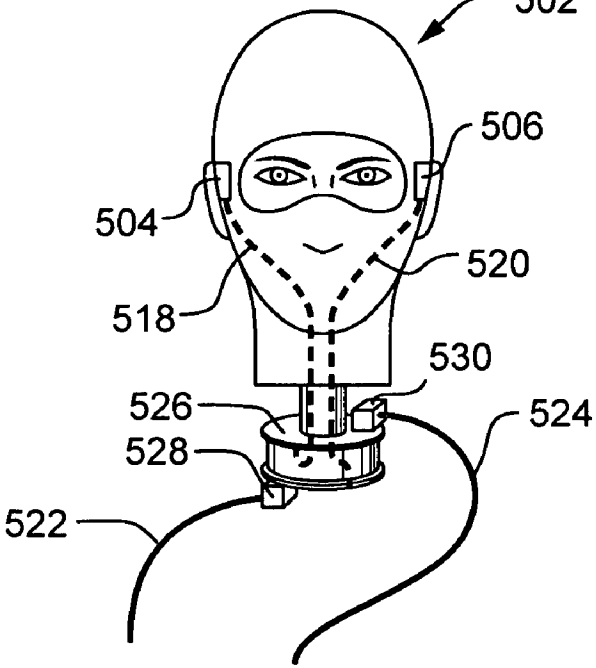
FIG. 5*a* is a front view of a head and neck of an action figure according to the present invention.

Furthermore, as will be clear to those of skill in the art, the present invention permits conductive articulation for limbs other than arms. For example, a pivoting contact apparatus may be similarly employed to provide current through a figure's articulated hip joint, while a hinged contact apparatus may be employed to provide current through a figure's articulated knee joint. Furthermore, a pivoting contact apparatus may be similarly employed to provide current through a figure's articulated waist, allowing pivoting in the horizontal plane. Yet further, as illustrated in FIG. 5, the invention also permits employment of a pivoting contact apparatus to provide current to suitably located conductive areas on a figure's head through the figure's articulated neck. Because the pivoting contact apparatus technology is the same for articulated waists and necks as it is for articulated shoulders and hips, as used in this description the term "limb" will refer to any portion of the body pivotingly connected to the figure's torso, such as an arm, a leg, a head, or a lower body.

Located on the exterior of head 502 are conductive areas 504, 506. Provided with the figure is a pair of simulated goggles 508 with LEDs 510, 512 as eyepieces. Head 502 and goggles 508 are fashioned so that the goggles may be removably retained on the head as eyewear. On the interior portion of goggles 508 are conductive areas 514, 516, so located that, when the goggles are retained on the head, areas 514, 516 on the goggles are in electrical contact with conductive areas 504, 506 on the head. Current is conducted through head 502 to conductive areas 504, 506 via wires 518, 520 running through the interior of head 502. Current is passed from conductors 522, 524 in the figure's torso (corresponding to conductors 110, 112 in FIG. 1) through the figure's pivoting articulated neck by way of a disc and pin assembly 526, in communication with brushes 528, 530, forming a pivoting contact apparatus such as that discussed above in relation to the shoulder joint depicted in FIG. 4. Thereby, current may be conducted from the figure's torso through the articulated neck and through the figure's head to operate the LEDs in the goggles.

Figure 6:
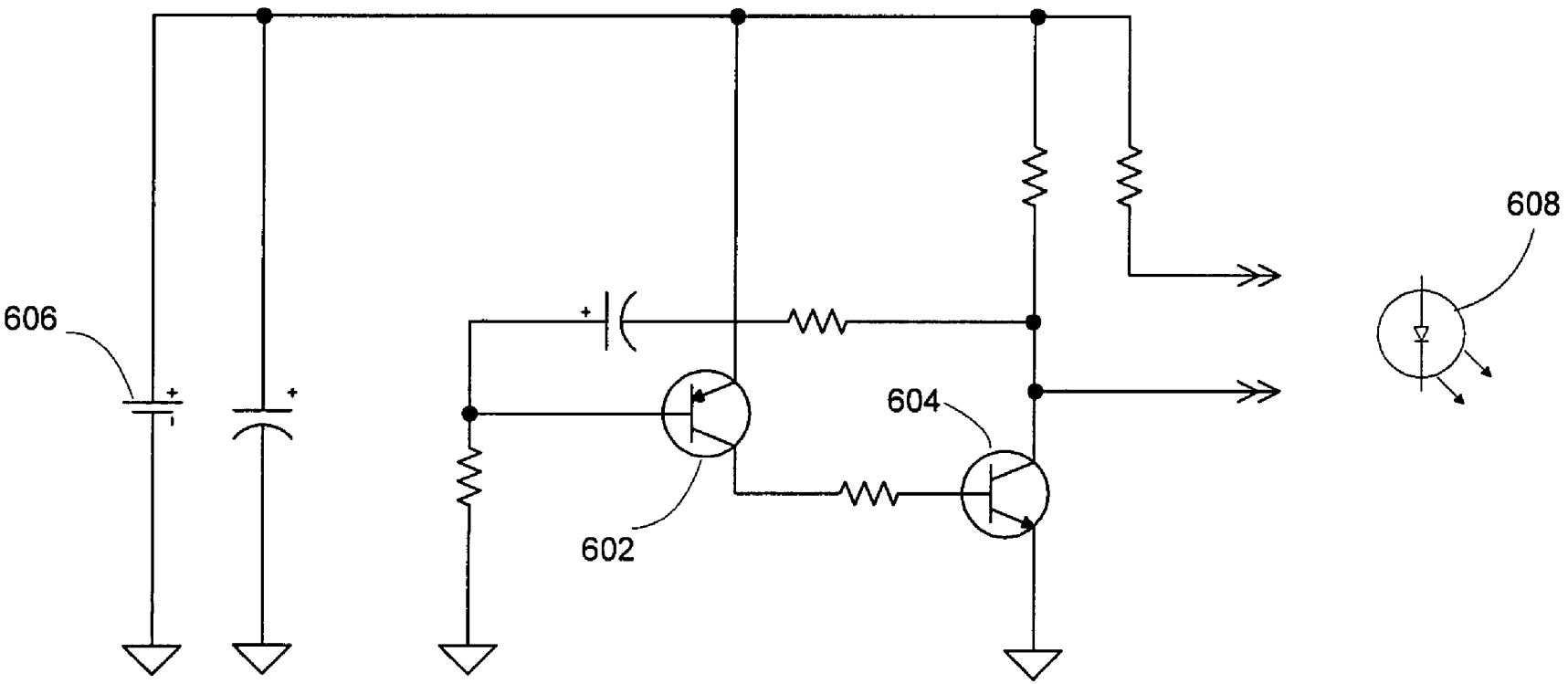
FIG. 6 is a circuit diagram of a pulsing circuit according to the present invention.

The amusement utility of the present invention may be enhanced by providing pulsed current through the figure, for example to flash LEDs in accessories. A simple circuit for providing flashing functionality is illustrated in FIG. 6, wherein PNP transistor 602 is paired with NPN transistor 604 to pulse current from battery 606, thereby causing LED 608 to flash. As will be clear to those of skill in the art, the flashing circuit may be miniaturized and located inside the action figure's torso or within a suitably sized accessory in electrical contact with the battery by way of the conducting action figure. In alternative embodiments, a miniaturized flashing circuit may be located within the battery pack.

Embodiments of the present invention may conduct current which is either pulsed or steady as selected by the user. For example, as will be understood by those of skill in the art, in some embodiments the figure, cooperating accessory or battery pack may be fitted with one or more microswitches selectively engaging or bypassing a pulsing circuit such as that described above in reference to FIG. 6, whereby the user may select between pulsed or steady current supplied to the accessory.

Figure 7A:
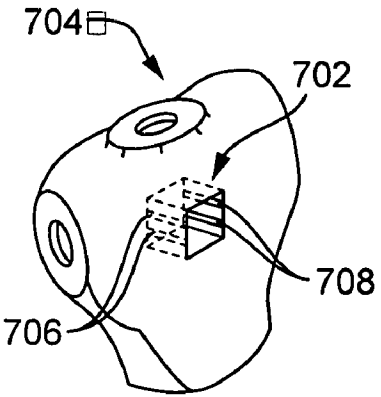
FIG. 7 depicts elements of an alternative embodiment of the present invention incorporating both steady and pulsed current circuitry.

Other embodiments of the present invention may also be employed to select pulsed or steady current to be delivered to the figure's extremities. Turning now to FIG. 7*a*, illustrated is a rear view of a figure's torso according to the present invention. Rectangular receptacle 702 in torso 704 contains two pairs of conductive areas, 706 and 708. Conductive area pair 706 is electrically connected to receive current and pass it directly to the figure's extremities in a steady form. Conductive area pair 708 is electrically connected to a pulsing circuit such as that illustrated in FIG. 6 above, passing current through conductors to the pulsing circuit to deliver pulsed current to the figure's extremities.

Figure 7B:
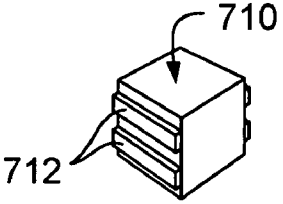
Figure 7C:
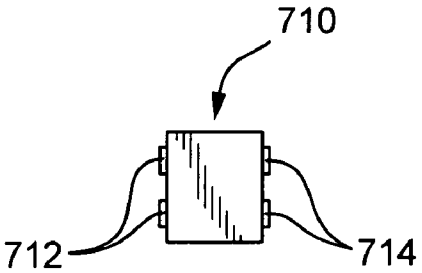
Figure 7D:
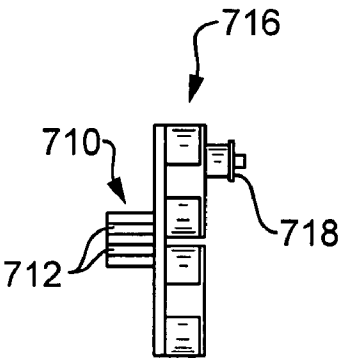
Figure 7E:
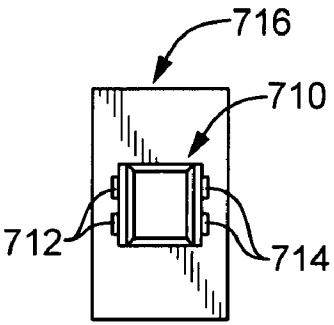

FIGS. 7*b*, 7*c* illustrate a piece 710 adapted to be received by receptacle 702, on which are located two pairs of conductive areas 712, 714, disposed to provide electrical contact to cooperating conductive areas 706, 708 respectively in receptacle 702 in torso 704 when piece 710 is removably retained within receptacle 702. Piece 710 may be integral to a battery pack such as a simulated backpack 716, as illustrated in FIGS. 7*d* and 7*e*. In the alternative, as will be clear to those of skill in the art, piece 710 may be removably retained in electrical contact with a battery pack. In any case, electrical conductors within the battery pack selectively conduct electricity either to pair 712 or to pair 714 on piece 710. When electricity is conducted to pair 712 when piece 710 is retained within receptacle 702, conductive area pair 706 receives current and passes it directly to the figure's extremities in steady form. In a like manner, when electricity is conducted to pair 714 when piece 710 is retained within receptacle 702, conductive area pair 708 receives current and current passes it through conductors to the pulsing circuit to deliver pulsed current to the figure's extremities. As will be well understood by those of skill in the art, various means may be incorporated in the battery pack for selecting which of pair 712, 714 receives current. Such means include placing a manual single pole dual throw switch 718 in the conductive path from the batteries to the pairs of conductive areas. Other means of selecting which pair receives current, such as a relay or a semiconductor switch, will be apparent to those of skill in the art.

Figure 8:
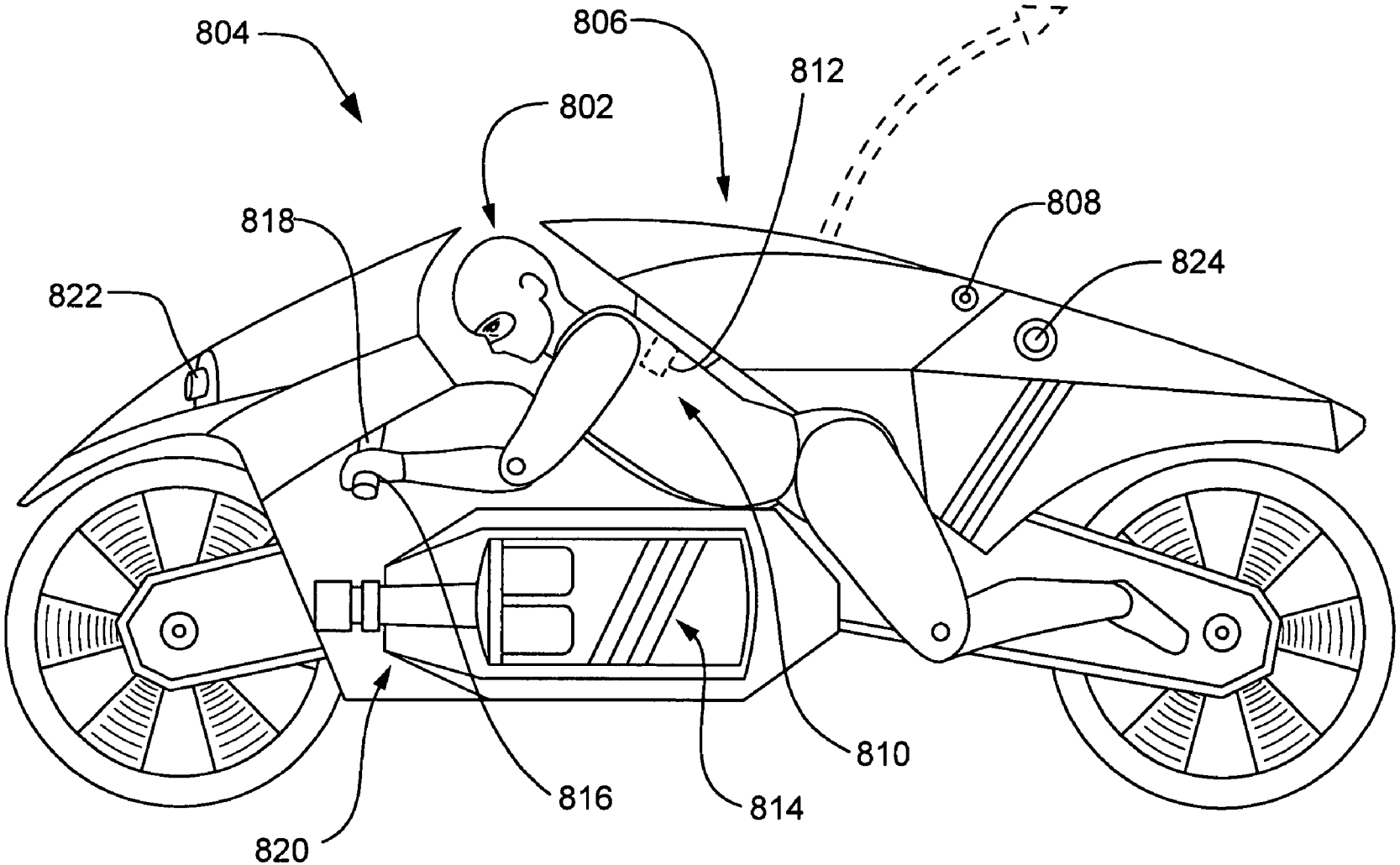
FIG. 8 depicts an embodiment of the action figure with a simulated vehicle accessory.

While the present invention may be usefully employed in providing power from a small battery pack to a small accessory such as the laser handgun or goggles discussed above, the present invention also affords other applications useful for amusement. Turning now to FIG. 8, illustrated is an embodiment wherein the figure provides a conduit for electricity from a battery source in a larger accessory, such as a simulated vehicle, to power electrical aspects of the accessory. Action FIG. 802 is placed within accessory vehicle 804. Vehicle 804 has a cowling 806 that is hinged 808 to lift up for insertion and removal of FIG. 802. Within action FIG. 802 is a receptacle 810 as described in reference to FIG. 1 or alternatively in reference to FIG. 7, cooperatively receiving piece 812 on the underside of cowling 806, and electrically connecting FIG. 802 to receive current from vehicle 804. Vehicle 804 serves as the battery source, with compartment 814 for retaining batteries to provide power through FIG. 802.

Current is conducted through FIG. 802 to conducting areas 816 in the figure's hands, in contact with conducting areas 818 on the vehicle's handlebars for receiving current conducted through the figure, as described generally above in reference to FIG. 1. Current received by the vehicle in this manner is then conducted within the vehicle to provide power to electrical features of the vehicle, such as motorized feature 820 or LED headlights 822. In some embodiments, switch 824 on vehicle 804 may be used to turn current supplied to and by the figure on and off. In other embodiments, switch 824 may be used to select between pulsed and steady current supplied by the figure, as discussed above in reference to FIG. 7. In yet other embodiments, power is supplied to the accessory vehicle 804 as soon as FIG. 802 is connected.

As will be appreciated by those of skill in the art, because this versatile invention provides a means of conducting current through a figure at its points of articulation without requiring flexing of conductors, the figure may be advantageously posed and manipulated to cooperate with any number of other arrangements of power supply and accessory without risk of breaking the continuity of electrical conduction at the figure's articulated joints. Furthermore, embodiments of this invention permit employment of novel means of selecting pulsed or steady power supply through the figure, enhancing its utility for amusement.

Although the detailed descriptions above contain many specifics, these should not be construed as limiting the scope of the invention but as merely providing illustrations of some of the presently preferred embodiments of this invention. Various other embodiments and ramifications are possible within its scope, a number of which are discussed in general terms above.

While the invention has been described with a certain degree of particularity, it should be recognized that elements thereof may be altered by persons skilled in the art without departing from the spirit and scope of the invention. Accordingly, the present invention is not intended to be limited to the specific forms set forth herein, but on the contrary, it is intended to cover such alternatives, modifications and equivalents as can be reasonably included within the scope of the invention. The invention is limited only by the following claims and their equivalents.

I claim:

1. An action figure for providing current to an electrical accessory with electrical contact points, comprising:

a hollow torso;

a hollow pivoting limb abutting the torso;

a first conductor pair comprised of a first and a second conductor within the torso;

a second conductor pair comprised of a first and a second conductor within the hollow pivoting limb;

a pair of conductive areas on the surface of the limb for contact with the electrical contact points of the accessory, the conductive areas in electrical communication with the second conductor pair; and a pivoting contact apparatus pivotingly coupling the limb to the torso and electrically coupling the first conductor pair to the second conductor pair, the pivoting contact apparatus comprising:

a first disc-brush apparatus, comprising a disc in electrical communication with the first conductor of the first conductor pair, the disc rotatably in mechanical and electrical contact with a brush in electrical communication with the first conductor of the second conductor pair;

a second disc-brush apparatus, comprising a disc in electrical communication with the second conductor of the first conductor pair, the disc rotatably in mechanical and electrical contact with a brush in electrical communication with the second conductor of the second conductor pair; and a dielectric separating the first disc-brush apparatus from the second disc-brush apparatus.

* * * * *